US006584978B1

(12) United States Patent
Brett et al.

(10) Patent No.: US 6,584,978 B1
(45) Date of Patent: Jul. 1, 2003

(54) MOUTHGUARD AND METHOD OF MAKING

(75) Inventors: Daniel J. Brett, Kent, OH (US); Michael C. Geiger, Kent, OH (US)

(73) Assignee: Sportsguard Laboratories, Inc., Kent, OH (US)

( * ) Notice: Subject to any disclaimer, the term of this patent is extended or adjusted under 35 U.S.C. 154(b) by 0 days.

(21) Appl. No.: 10/155,443

(22) Filed: May 24, 2002

Related U.S. Application Data

(60) Provisional application No. 60/293,789, filed on May 25, 2001.

(51) Int. Cl.[7] ..... A61C 5/14
(52) U.S. Cl. ..... 128/859
(58) Field of Search ..... 128/846, 848, 128/859–862; 602/902; 433/6, 48

(56) References Cited

U.S. PATENT DOCUMENTS 5,299,936 A * 4/1994 Ueno ..... 128/861
5,415,544 A * 5/1995 Oxman ..... 433/48
5,513,984 A * 5/1996 Ueno ..... 128/861

* cited by examiner

*Primary Examiner*—Michael A. Brown
(74) *Attorney, Agent, or Firm*—Hahn Loesner & Parks, LLP; Stephen L. Grant

(57) ABSTRACT

The present invention relates to a bilayer mouthguard fabricated from a high impact thermoplastic polymer blend having the ability to absorb, attenuate, and dissipate shock forces and a method of fabricating a mouthguard. The present invention utilizes a polymer blend comprising ethylene vinyl acetate and a thermoplastic urethane. The bilayer mouthguard has a U-shape base and is defined by inner lingual and outer labial walls, a channel for receiving the upper jaw and teeth, cushion pads laying within the U-shape base, and in certain designs a transition support portion extending forward from the posterior cushion pads connecting with an anterior impact brace that extends into the outer labial wall.

16 Claims, 6 Drawing Sheets

MOUTHGUARD AND METHOD OF MAKING

This application claims the benefit of U.S. provisional Application Serial No. 60/293,789, filed May 25, 2001. Application Serial No.60/293,789 is hereby incorporated by reference.

TECHNICAL FIELD

The present invention is directed to a mouthguard fabricated from a polymer blend comprising ethylene vinyl acetate and thermoplastic polyurethane, and a method of fabricating a mouthguard from such a polymer blend.

BACKGROUND OF THE ART

Conventionally, in a contact sport such as football, basketball, hockey or the like, an accident, for example, fracture of jaw bone, a laceration of soft tissue of the oral cavity, or the like, has frequently happened. Accordingly, in order to prevent such an accident, it is desired to put a mouthpiece in a mouth.

A number of mouthguards currently exist in the art for protecting the teeth and for reducing the chance of shock, concussions and other injuries as a result of high impact collisions and blows during athletic competition. Mouthguards generally are characterized as being nonpersonalized, universal and stock model type; "boil and bite"; and custom thermoformed to have upper jaw and teeth direct contact. Additionally, mouthguards may be tethered or untethered. Tethered mouthguards are usually connected to a fastening point, such as a helmet or face guard, to prevent the chance of the mouthguard from being lost as well as to prevent swallowing of the mouthguard or choking on the mouthguard by the user.

Failure to use a mouthguard or the use of an improperly fitted mouthguard when impacts, collisions or blows occur to the jaw structure of an athlete have been found to be responsible for athletes' susceptibility to headaches, presence of earaches, ringing in the ears, clogged ears, vertigo, concussions and dizziness. The cause of these types of health problems and injuries are generally not visible by inspection of the mouth or jaw, but more particularly relate to the temporomandibular joint (TMJ) and surrounding tissues where the lower jaw is connected to the skull in the proximity where the auriculo-temporalis nerves and supratemporal arteries pass from the neck nerves into the skull to the brain.

Most mouthguards in the past have been made from ethylene vinyl acetate (EVA). The material has a softening point approximating the temperature of boiling water which will permit the mouthguard to be placed in boiling water and custom fit to the wearer's mouth. However, the EVA material, although the best known to date, is not ideal for absorption, attenuation, and dissipation of shock forces exerted on the EVA mouthguard during athletic activity. Furthermore, the EVA material is subject to deformation and break down with continued use and chewing thereon by the wearer. There is a need, therefore, for a mouthguard having a higher ability for the absorption, attenuation and dissipation of shock forces as compared with conventional, EVA mouthguards.

SUMMARY OF THE INVENTION

This and other objects of the invention are achieved by a mouthguard, fitted to the molar and incisor teeth and gums of a human user. Such a mouthguard comprises a blend of ethylene vinyl acetate (EVA) and thermoplastic urethane (TPU), especially a blend, wherein the EVA is present in the range of about 5 to about 95% by weight and the balance is TPU.

In some aspects, the mouthguard is fitted at a temperature in excess of 100° C. with reference to a model of the human user's teeth. In other aspects, the mouthguard is fitted at a temperature of less than 100° C. with direct reference to the human user's teeth.

In these latter embodiments, the mouthguard comprises a generally U-shaped body with an upper surface and a lower surface, the upper surface having a channel fitted to the upper molar and incisor teeth and gums of the user. A first arm portion of the body corresponds to the right upper molars and gums of the user and a second arm portion of the body corresponds to the left upper molars and gums of the user. A base portion joining the first and second arm portions corresponds to the incisors and gums of the user. In some of these embodiments, a first cushion pad is arranged in the first arm portion and a second cushion pad is arranged in the second arm portion.

BRIEF DESCRIPTION OF THE DRAWINGS

Embodiments of the present invention will be described with reference to the accompanying drawings wherein like numerals designate like areas and in which.

DETAILED DESCRIPTION OF THE PREFERRED EMBODIMENT

The invention will now be described with reference to certain illustrated embodiments that shows a mouthguard having a higher ability for the absorption, attenuation, and dissipation of shock forces as compared with conventional mouthguards and a method of constructing such a mouthguard.

Figure 1:
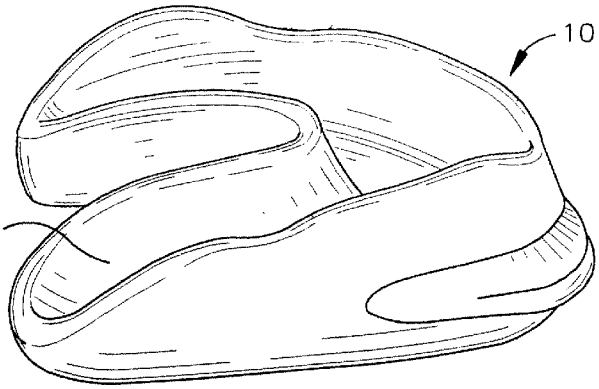
FIG. 1 shows a side perspective view of the custom fit mouthguard.
Figure 2:
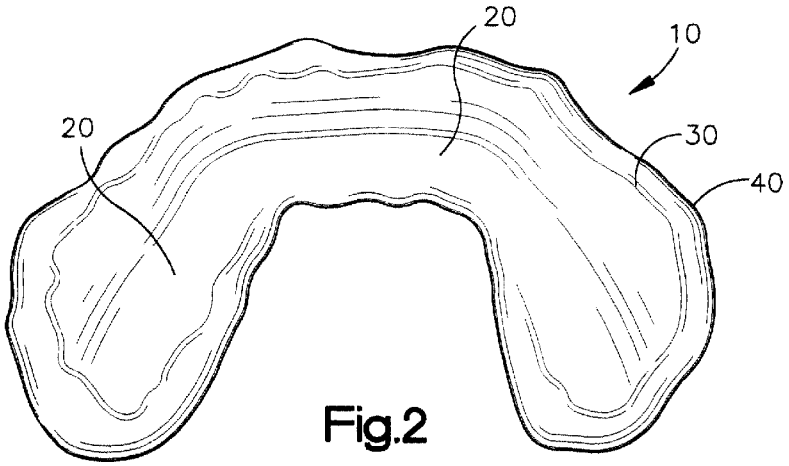
FIG. 2 shows the rear view of the custom fit mouthguard of the present invention.

One embodiment of the custom fit mouthguard 10 of the present invention is shown in FIGS. 1 and 2. The custom fit mouthguard as shown in FIGS. 1 and 2 is produced in such a manner as follows. First, an impression of teeth from an prospective user is modeled by using a dental impression material, such as an alginate impression material, so as to form a plaster cast of the teeth. The EVA/TPU blend is first shaped into a plate having a thickness of from about 1 to about 5 mm is softened by heating to a temperature of about 220° F. to allow the EVA/TPU to soften. Vacuum or positive pressure is then applied to force the softened EVA/TPU to conform to the contours of the teeth cast. The actual thickness used depends upon the resistance to shock and impact forces desired and the desired level of comfort in the user. Typically, a thicker layer will provide more resistance to shock and impact forces, but will also be less comfortable to the user due to the bulk of the mouthpiece. A good fit to the teeth is generally obtained in mouthguard 10 with the teeth impressions 20. Conventionally, the thermoplastic material used has been EVA, due to its ease of moldability and translucence.

In conventional bilayer EVA mouthguards, it is necessary to use a positive pressure type thermoforming device to provide adequate pressure to obtain good adhesion between the EVA layers. Such positive pressure thermoforming devices provide pressure of about 90 psi (6 atmospheres) to force the softened polymer into a tight, compliant fit around the teeth cast. In the present invention, however, adequate adhesion between layers of the EVA/TPU blend may be obtained using a vacuum thermoforming device, which is more typically available in a dental professional's practice than is the more expensive positive pressure type thermoforming device. If a bilayer EVA mouthguard is fabricated on a vacuum thermoforming device, the adhesion between the layers is poor and voids between the layers may result. Subsequent use of a bilayer EVA mouthguard may result in delamination of the layers, with a limited lifetime for the mouthguard. Typically, EVA mouthguards produced using conventional vacuum thermoforming are limited to a single layer of EVA, to avoid the problems with delamination.

In contrast, the bilayer EVA/TPU blend mouthguard of the present invention fabricated using a vacuum thermoforming device shows good adhesion between the layers and little or no void formation. Moreover, in one embodiment, a mouthguard may be fabricated from a first layer of the EVA/TPU blend, and a second layer of EVA, using a vacuum thermoforming device. Bilayer mouthguards of one layer of EVA/TPU and a second layer of EVA fabricated with a vacuum thermoforming device show surprisingly good adhesion between the layers and little or no void formation, in contrast to bilayer EVA mouthguards, which must be fabricated using a positive pressure thermoforming device to achieve an adequate level of adhesion between the layers.

The mouthguards of the present invention including at least one layer of EVA/TPU may of course be fabricated on either a vacuum thermoforming device or a positive pressure thermoforming device. Adhesion between adjacent layers of EVA/TPU and EVA/TPU, or between EVA/TPU and EVA, is adequate using either method. However, better fit of the mouthguard to the teeth is realized using the positive pressure thermoforming device rather than the vacuum thermoforming device, since the applied pressure is much higher in the positive pressure thermoforming device.

While the use of conventional vacuum thermoforming equipment or positive pressure thermoforming equipment are both suitable for fabricating mouthguards by the methods of the present invention, the invention is not limited to the use of such equipment. Any device or method that results in a mouthguard utilizing an EVA/TPU polymer is within the scope of the invention.

In one embodiment, identifying indicia may be laminated between a layer of EVA/TPU and a layer of EVA. The clarity of the EVA layer allows a clear view of the indicia. For example, a team logo, player number, or player name may be placed over the first formed layer of EVA/TPU, with the EVA layer then thermoformed over the indicia and the EVA/TPU layer. The indicia may be of any heat resistance plastic or other suitable material. The indicia may include a pressure sensitive adhesive to facilitate placement on the EVA/TPU layer.

Referring to FIG. 2, a second layer 40 of EVA/TPU blend may be added to the first layer 30 of EVA, either over the entire first layer or cut in a specific pattern so as to allow added thickness in desired regions of the mouthguard. In one embodiment, a second layer of EVA/TPU may be added in the anterior maxillary teeth area of the mouthguard, to provide added protection from frontal impacts that take place at the buccal surface. Added thickness may also be included in the molar areas to provide additional protection from impact that would otherwise transfer through the condyles of the jaw to the base of the brain, possibly causing concussion to the user. The second layer is applied in a similar manner to the first, with heat first applied to soften the polymer followed by vacuum or positive pressure to conform the polymer to the contours of the teeth.

In another embodiment, a boil and bite mouthguard may be fabricated from the EVA/TPU blend. The boil and bite mouthguard is shown in FIGS. 3–9. In contrast to the custom fit mouthguard, wherein the size of the mouthguard is determined by the plaster cast used, boil and bite mouthguards are "off the shelf" and are pre-sized to fit generally child and adult mouth sizes. The child version is generally in the range of about 20 to 30 percent smaller than the adult size.

As is known, the boil and bite mouthguard is fitted to a user's mouth by first immersing the mouthguard in boiling water at 100° C. for a short period of time, typically 10 to 30 seconds to soften the polymer, followed by insertion over the user's upper teeth, with compression applied by biting down on the mouthguard and sucking the air out of the mouthguard to form the mouthguard to the user's teeth. One problem with the boil and bite mouthguard, particularly with EVA mouthguards, comes from excessive pressure applied by the user when biting down on the softened mouthguard. The user often bites through the majority of the thickness of this mouthguard, leaving little thickness to protect against compression and shock forces transferred through the molars and subsequently to the base of the brain.

In one embodiment of the present invention, a 75/25 EVA/TPU material in the boil and bite mouthguard is approximately 5 mm thick in the biting surface, particularly between the molars. Even with this thickness, the user may bite through the bulk of the material, particularly with the more pliable blend of 75 percent EVA and 25 percent TPU. With the 75/25 material, it is intended that at least 1 to 2 mm of material thickness will remain after biting, more specifically about 1.5 mm, but this is may not give the desired protection against shock and concussion. As an alternative, in one embodiment a blend of EVA/TPU having about 50 percent EVA and 50 percent TPU is used to offer increased thickness in the mouthguard. The 50/50 blend is less moldable than the 75/25 blend, and thus resists excessive biting by the user. An acceptable dental impression may be made in the 50/50 blend during the boil and bite procedure, but it is intended that the resulting mouthguard has a greater thickness retained in the molar areas after biting to provide greater resistance to shock and compression forces. In one embodiment, the boil and bite mouthguard may include concussion pads within the boil and bite mouthguard to afford additional protection. The overall thickness of the mouthguard may be about 5 mm, with 2 mm of the 75/25 material surrounding 3 mm thick pads of the 50/50 material. In this way, greater protection may be afforded against impact, and the desired thickness of 3 mm will remain after biting. In another embodiment, the biting surface thickness of the mouthguard may be about 5 mm, with 2 mm of the 75/25 material surrounding 3 mm thick pads of the KRATON/TPU/EVA blend. In this way, greater protection may be afforded against impact, and the desired thickness of 3 mm will remain after biting.

In another embodiment, added thickness in the molar area of the mouthguard may be obtained by placing pads of the 50/50 EVA/TPU or 45/45/10 KRATON/TPU/EVA blends in the occlusal portion of the mouthguard. Typically, impact from a blow to the jaw causing concussion affects the posterior region first, with the posterior teeth coming together first thus transferring the shock and concussion forces to the lower brain. The added thickness provided by the pads, or concussion pads, provides added protection against shock forces to the posterior teeth and thereby will reduce the rate of concussion.

In another embodiment, trauma to the anterior maxillary teeth is reduced through the use of added thickness in the mouthguard. Statistics show that 80 percent of trauma occurs to the maxillary front teeth. As with the concussion pads, anterior maxillary pads may be added to the anterior maxillary area of the mouthguard to provide added protection against trauma to the maxillary teeth located at the buccal surface.

In both cases of pads added for extra thickness and protection, i.e., concussion pads and maxillary pads, the mouthguard is fabricated using a two shot injection molding process. The first molding utilizes a the less moldable material, such as the 50/50 EVA/TPU, to place the desired concussion and/or maxillary pads. A second injection molding follows the first, with the second molding shot utilizing the more moldable, 75/25 EVA/TPU surrounding the first shot of 50/50 material. In another embodiment, the first molding is for the back of the mouthguard utilizes the 75/25 EVA/TPU and the second molding utilizes a less moldable material, such as the KRATON/TPU/EVA, that allow the desired concussion and/or anterior maxillary pads to be placed into the first shot of the 75/25 EVA/TPU material.

Referring to FIGS. 3–9, the boil and bite mouthguard may be generally seen. This mouthguard 100 is comprised of a thermoplastic mouthguard portion 102, which is generally U-shaped, with the embedded or substantially internal elastomeric framework 106 forming cushion pads 116 and/or an anterior impact brace 108.

More particularly, the thermoplastic mouthguard portion 102 suitably may be made of EVA, or of EVA/TPU blend. The thermoplastic mouthguard portion 102 has a U-shaped base 124 with a top 128 and a bottom side 126. Extending upwardly are inner lingual and outer labial walls 130 and 132 forming a channel 129 there between for receiving the upper jaw and teeth. The thermoplastic mouthguard portion 102 has a posterior portion 112 and an anterior portion 114.

The elastomeric framework 106 suitably is made of an EVA/TPU blend, which exhibits a high resilience, low compression, shape maintenance and shock absorption, attenuation and dissipation. In one embodiment, a 50/50 weight percent blend of EVA/TPU, also known as Compound B, is used to fabricate the elastomeric framework 106. In another embodiment, the elastomeric framework 106 suitably is made of a blend of EVA/TPU and further comprising some KRATON, a thermoplastic rubber, so that the blend exhibits high resilience, low compression, shape maintenance and shock absorption, attenuation and dissipation. A 45/45/10 weight percent blend of KRATON/TPU/EVA is used to fabricate the elastomeric framework 106 in this embodiment.

The elastomeric framework 106 is molded by being injected into thermoplastic mouthguard portion 102. The elastomeric framework 106 has cushion pads 116 which suitably lay within the U-shaped base 124. The cushion pads 116 have bosses 110 to secure cushion pads 116 within the mouthguard portion 102 molded around framework 106.

The cushion pads 116 assure proper fitting of the unfitted mouthguard 100 when softened by prohibiting the user from biting too deeply into the soft EVA/TPU material of the thermoplastic mouthguard portion 102. Also, the cushion pads 116 assure that there is no excessive upward displacement of the jaw.

Figure 3:
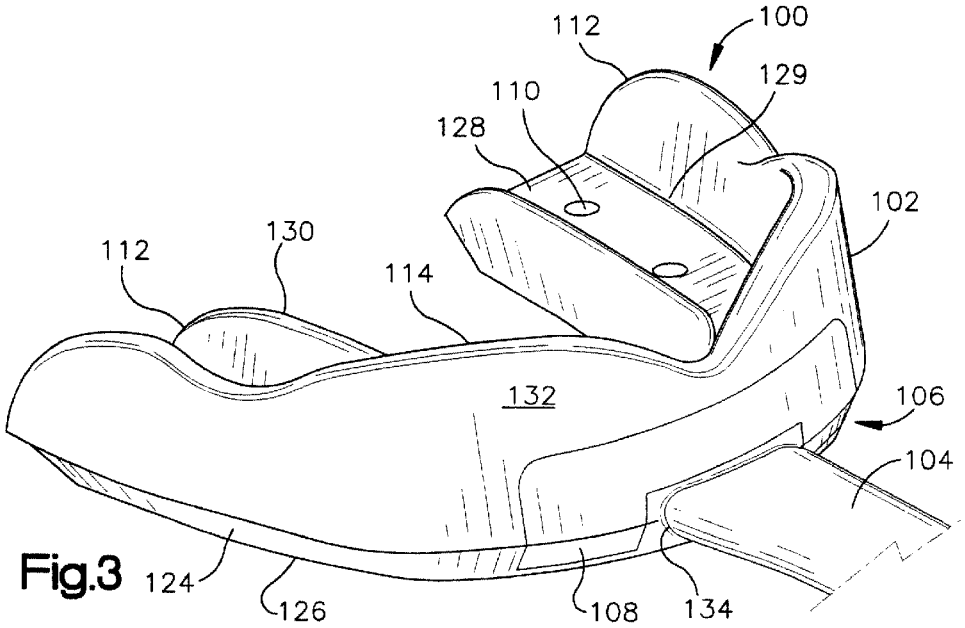
FIG. 3 shows a perspective view of a boil and bite mouthguard of the present invention.
Figure 7:
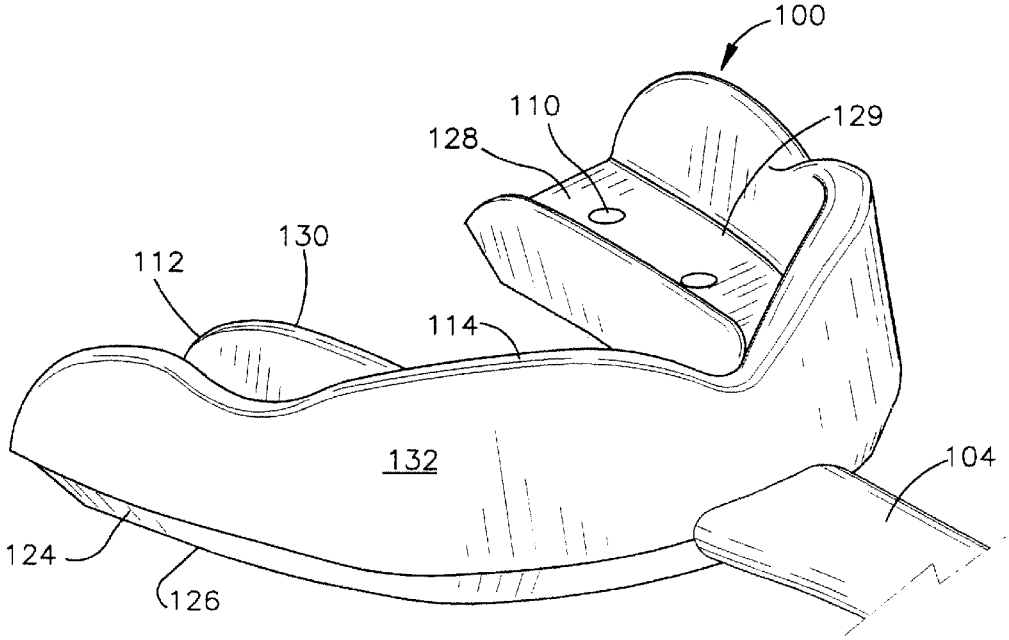
FIG. 7 shows a perspective view of a tethered boil and bite mouthguard without an anterior impact brace.
Figure 8:
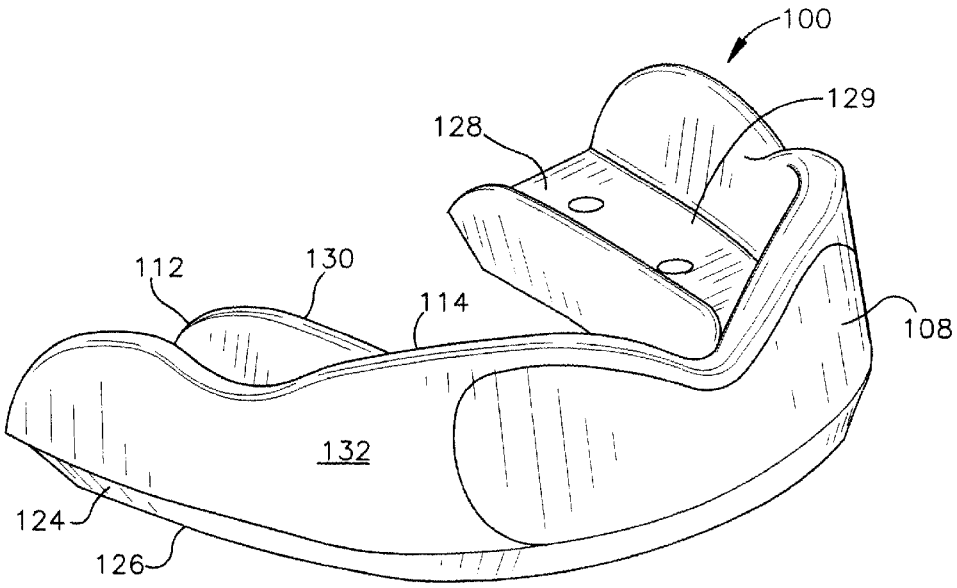
FIG. 8 shows a perspective view of a non-tethered boil and bite mouthguard with an anterior impact brace.

As seen in FIG. 3, a tether 104 suitably may be utilized with the unfitted mouthguard 100 to secure the mouthguard 100 to a user's helmet of the like. Tether 104 may be simultaneously molded with mouthguard section 102 which contains an anterior impact brace 108. Tether 104 is integrally molded with mouthguard section 102 at joint 134. Joint 134 fills recess 122 of framework 106 to provide for attachment of tether 104 to the unfitted mouthguard 100. In a simplified embodiment, as seen in FIG. 7, a tether 104 can be attached directly to the U-shaped base 124 and lack the anterior impact brace 108. In another embodiment, a non-tethered version of the mouthguard exists as seen in FIG. 8. The untethered version includes the anterior impact brace 108 and lacks the tether 104.

Figure 4:
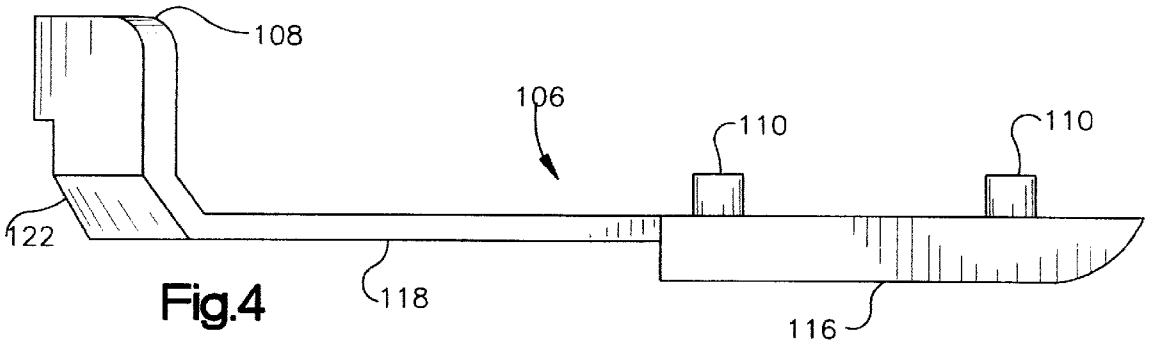
FIG. 4 shows a side view of the elastomeric framework of the boil and bite mouthguard.
Figure 5:
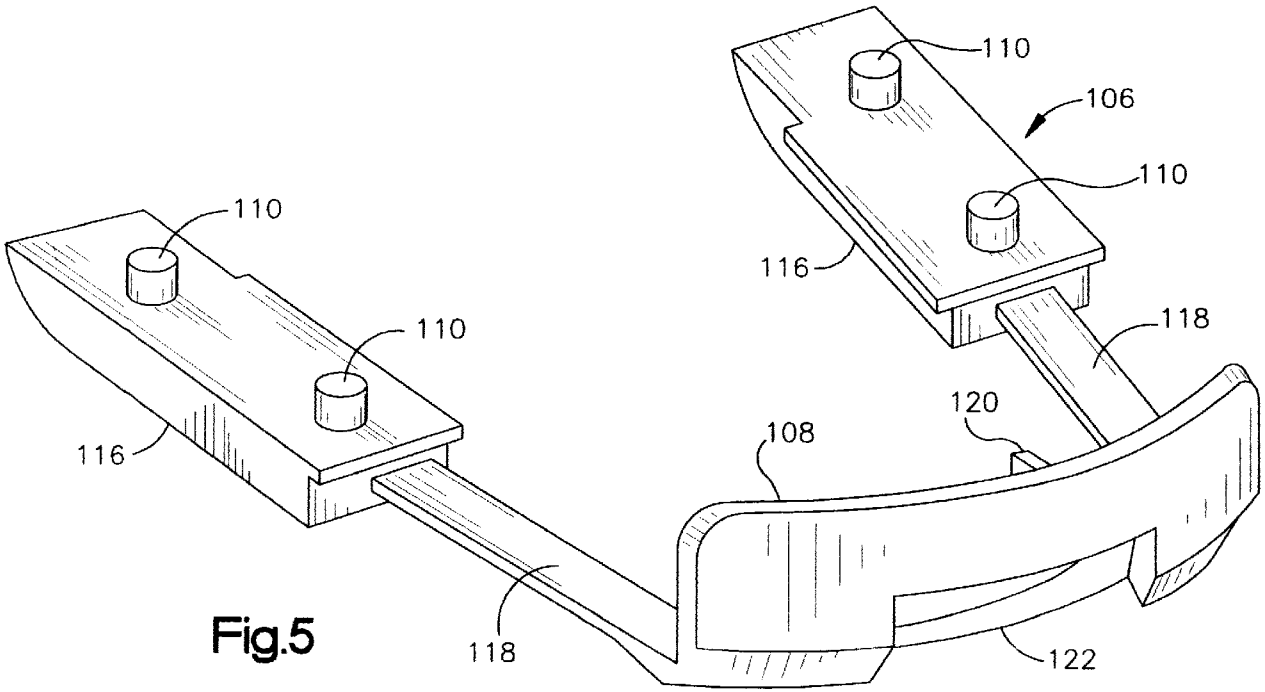
FIG. 5 shows a top view of the elastomeric framework of the boil and bite mouthguard.
Figure 6:
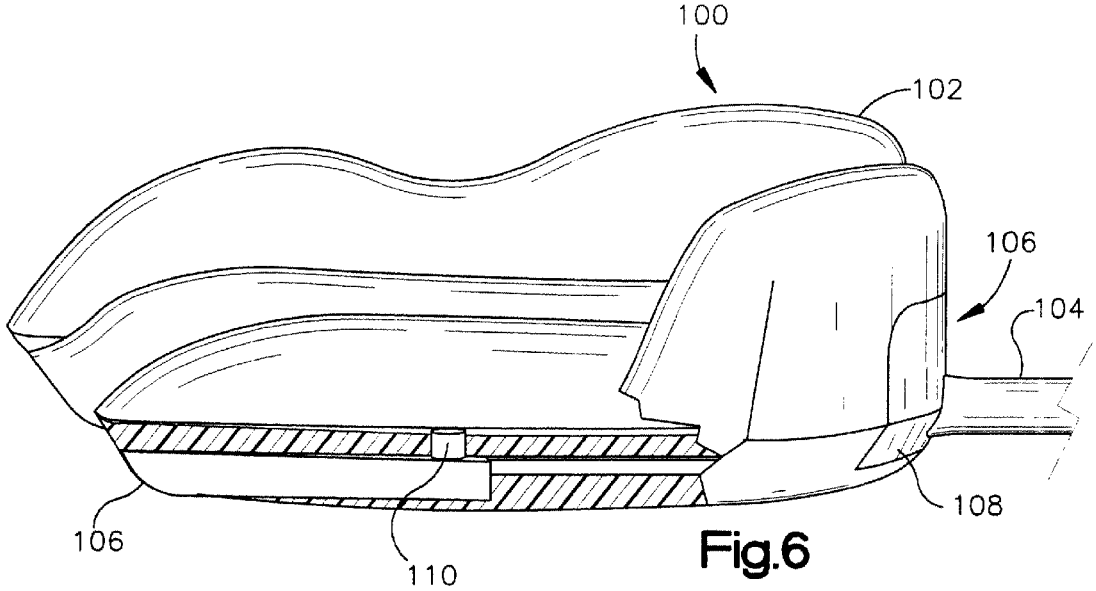
FIG. 6 shows a side view of the boil and bite mouthguard of the present invention.
Figure 9:
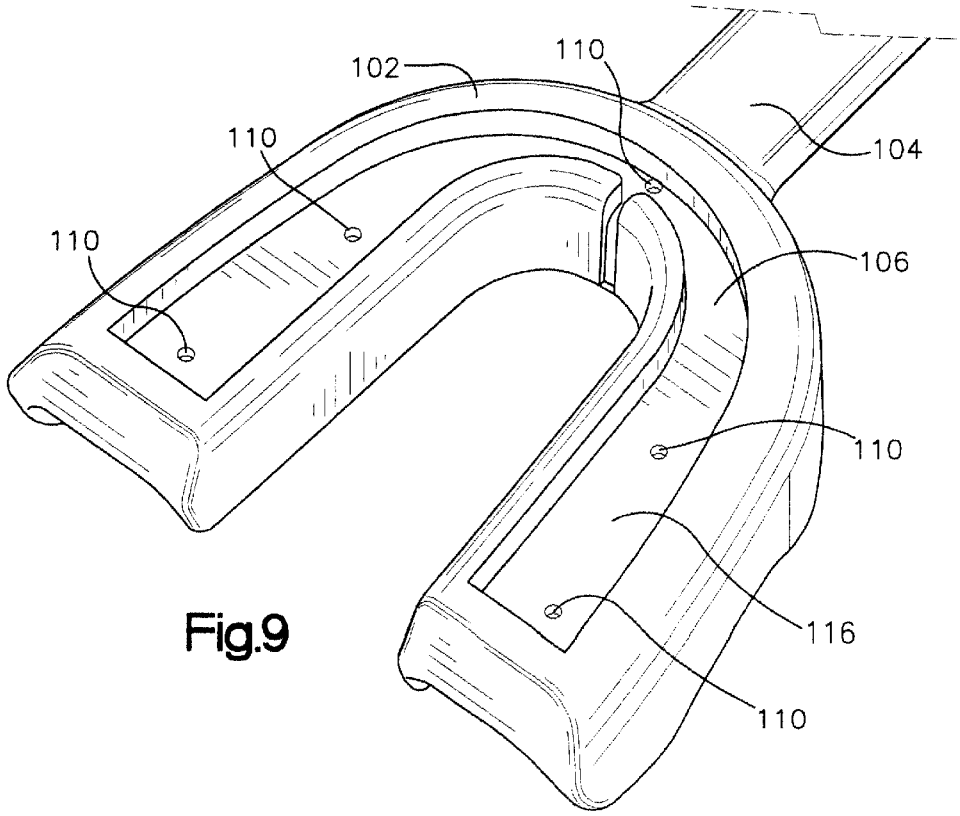
FIG. 9 shows a bottom view of a tethered boil and bite mouthguard with a horseshoe shaped impact brace without an anterior impact brace.

Moving forwardly, as seen in FIGS. 4 and 5, a transition support portion 118 extends forward from the posterior cushion pads 116 and connects to the anterior impact brace 108. Anterior impact brace 108 has a boss 120, which extends into the outer labial wall 132 to secure anterior impact brace 108 in mouthguard portion 102 molded around framework 106. In another embodiment, as seen in FIG. 9, the transition support portion 118 can be replaced altogether by molding the elastomeric framework 106 into a single piece. The elongated elastomeric framework would extend forward from the posterior cushion pads and connect in the anterior.

In operation, the composite mouthguard 100 may be momentarily submersed suitably into boiling water. Thereafter, the mouthguard 100 is immediately placed onto the teeth, the upper jaw of a user. Next, the lower jaw is positioned forwardly or anteriorly as the posterior teeth engage the topside 128. The wearer or user then applies suction between the upper jaw and the mouthguard 100 while packing the mouthguard 100 with the hands along the cheeks and lips adjacent the anterior and posterior teeth of the upper jaw. The posterior teeth of the lower jaw will properly index upon the bottom surface 126.

The composite mouthguard will position the user's jaw in a correct jaw posture for athletic participation, which will assure minimal impact to the surrounding tissues, teeth and respective jaws. The elastomeric framework 106 with its component parts will absorb, attenuate and dissipate shock forces as heretofore not known. In addition, posterior cushion pads 116 provide improved impact resistance and protection to the posterior teeth, while anterior impact brace 108 provides protection against impact for the anterior teeth.

To obtain a mouthguard having a superior ability to absorb, attenuate and dissipate shock forces experienced by a mouthguard user during an impact to the mouth or jaw area, the present invention utilizes a blend of EVA and TPU. For custom fit mouthguards, the EVA/TPU blend may be used as a single or multilayer construction, or alternatively, a first layer of EVA/TPU may be used with a second layer of EVA, with the option of laminating indentifying indicia between the layers. For boil and bite mouthguards, the EVA/TPU blend may be injection molded into the shape of the typical boil and bite mouthguard 100, as shown in FIG. 3.

The EVA/TPU blend useful in the present invention is any EVA/TPU blend having a weight ratio of EVA to TPU in a range of from about 5 to about 55 percent by weight of TPU and from about 95 to about 45 percent by weight of EVA. Optionally, from about 5 weight percent to about 15 weight percent of a sodium or zinc ionomer may be included in the EVA/TPU blend.

The EVA/TPU blend may be prepared from a variety of suitable thermoplastics. Suitable EVA materials include Escorene, Lupolen, Evatane, Elvax, Bynel, Ultrathene and Appeel, among others. Other ethylene-based copolymers may also be utilized. Suitable TPU materials include Pellethane, Elastollan, Desmopan, Texin, Estane, and Morthane, among others. Suitable ionomers include Iotek and Surlyn, among others.

In one embodiment, the EVA/TPU blend is Polypur FPU made by A. Schulman Inc. of Fairlawn, Ohio. In preparation of the Polypur FPU, the TPU and EVA (and optional colorants) are fed into a twin-screw extruder and compounded. This product may then either injection molded for boil and bite mouthguards or processed by extruding sheet for custom fit, thermoformed mouthguards. In one embodiment of the custom fit mouthguard, the EVA/TPU blend is Polypur FPU 1405, also known as Compound A, which comprises a blend of 75 percent EVA and 25 percent TPU. In another embodiment, the EVA/TPU blend comprises 50 percent EVA and 50 percent TPU and is known as Compound B. In another embodiment, a KRATON/TPU/EVA blend known as Compound E is comprised of 45 percent KRATON, 45 percent TPU, and 10 percent EVA. Generally, the more TPU and KRATON in the blend renders it less moldable, but offers a greater resistance to bite through.

The EVA/TPU blend is typically opaque; in one embodiment colorants may be added to the EVA/TPU blend to achieve a suitable aesthetic appearance.

For the purposes of this invention, the following examples are provided to illustrate the improved properties of the EVA/TPU and EVA/TPU/KRATON blends when compared to standard EVA alone. These formulations do not in any way limit the wide nature of the ability to formulate other products based on EVA, TPU, and/or KRATON.

EXAMPLE 1

Using ASTM-D3763, an EVA control was evaluated and the impact properties are summarized in Table 1. A total of five specimens were tested and measurements were taken and then averaged for impact energy (joules), impact velocity (m/sec), energy to maximum load (joules), and total impact energy (joules). As seen in Table 1, the average energy to maximum load was determined to be 5.42 joules and the total impact energy was 21.4 joules.

TABLE 1

| EVA CONTROL | | | | |
|---|---|---|---|---|
| SPECIMEN NUMBER | IMPACT ENERGY (joules) | IMPACT VELOCITY (m/sec) | ENERGY TO MAXIMUM LOAD (joules) | TOTAL ENERGY (Joules) |
| 1 | 117 | 2.24 | 5.8 | 23 |
| 2 | 116 | 2.24 | 5.5 | 23 |
| 3 | 116 | 2.23 | 5.2 | 21 |
| 4 | 116 | 2.24 | 5.3 | 20 |
| 5 | 116 | 2.23 | 5.3 | 20 |
| Average | 116.2 | 2.236 | 5.42 | 21.4 |

EXAMPLE 2

Figure 10:
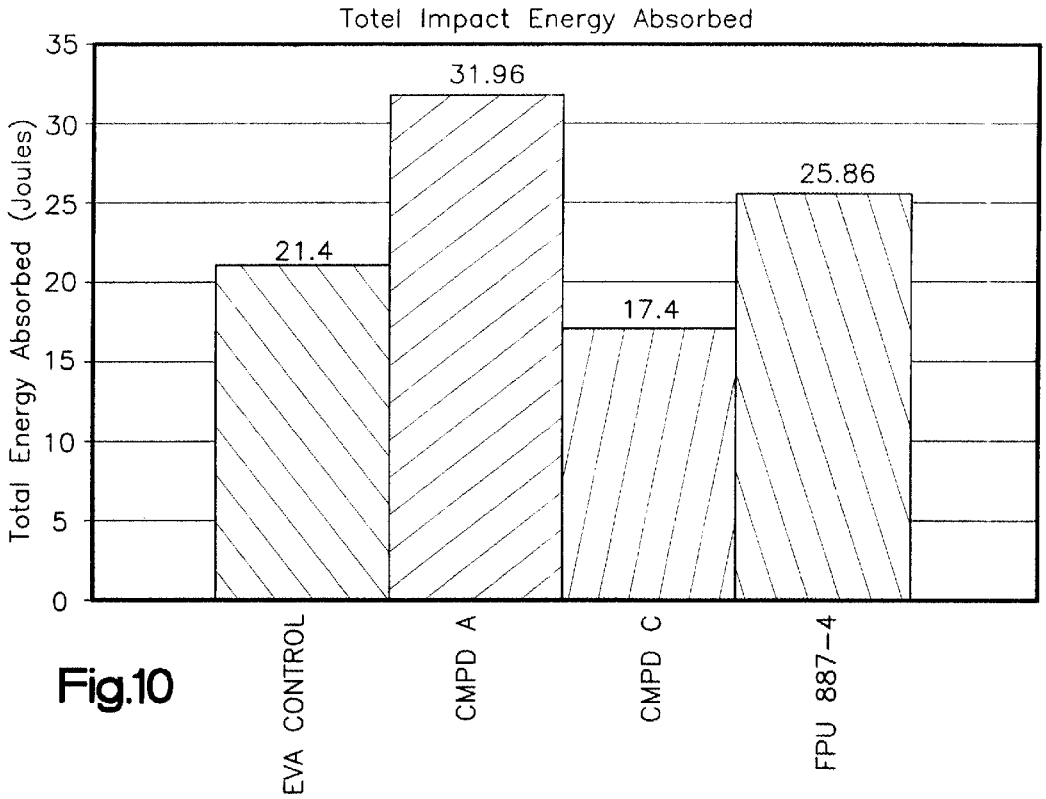
FIG. 10 shows a graph of the total energy absorbed for the thermoplastic materials used in the mouthguard of the present invention as compared with conventionally used EVA and modified EVA.
Figure 11:
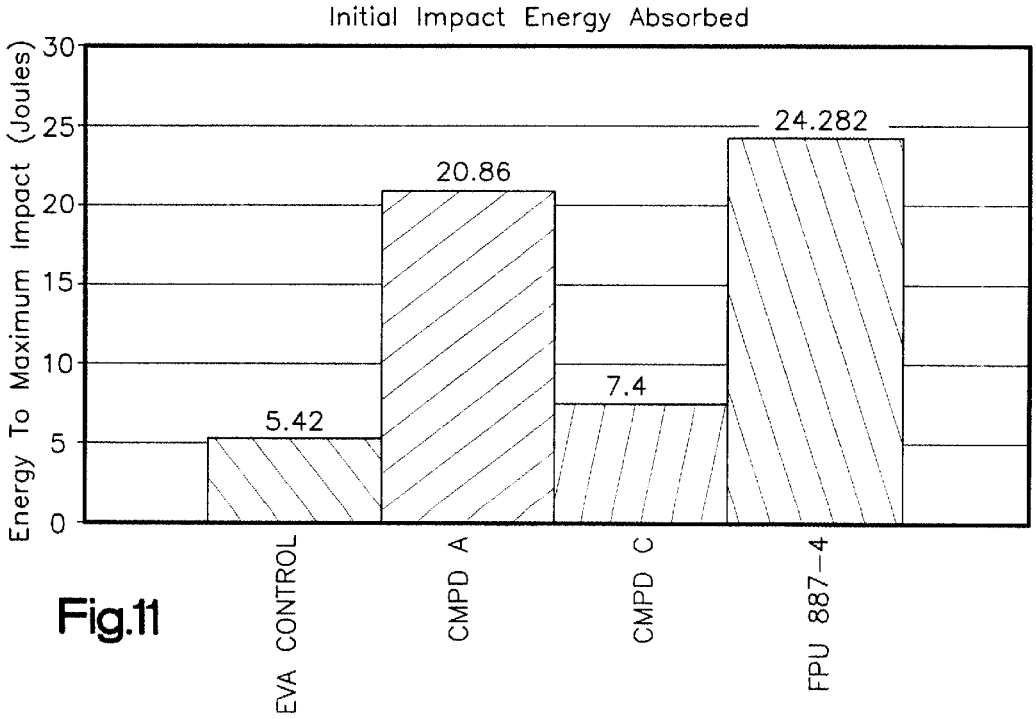
FIG. 11 shows a graph of the energy to maximum impact for the thermoplastic materials used in the mouthguard of the present invention as compared with conventionally used EVA and modified EVA.

Using ASTM-D3763, Compound A, a 75/25 blend of EVA/TPU, was evaluated and the impact properties are summarized in Table 2. A total of five specimens were tested and measurements were taken and then averaged for impact energy (joules), impact velocity (m/sec), energy to maximum load (joules), and total impact energy (joules). As seen in Table 2, the average energy to maximum load was determined to be 20.86 joules and the total impact energy was 31.96 joules. As seen in FIG. 10, when Compound A is compared to the EVA control, there is nearly a 50 percent increase in the total energy absorbed during impact. As seen in FIG. 11, when Compound A is compared to the EVA control, there is nearly a 300 percent increase in the energy to maximum impact.

TABLE 2

| Compound A | | | | |
|---|---|---|---|---|
| SPECIMEN NUMBER | IMPACT ENERGY (joules) | IMPACT VELOCITY (m/sec) | ENERGY TO MAXIMUM LOAD (joules) | TOTAL ENERGY (Joules) |
| 1 | 116 | 2.23 | 21.5 | 31.3 |
| 2 | 115 | 2.22 | 21.7 | 32.2 |
| 3 | 116 | 2.23 | 20.8 | 32.2 |
| 4 | 116 | 2.23 | 19.7 | 32.1 |
| 5 | 116 | 2.23 | 20.6 | 32 |
| Average | 115.8 | 2.228 | 20.86 | 31.96 |

EXAMPLE 3

Figure 13:
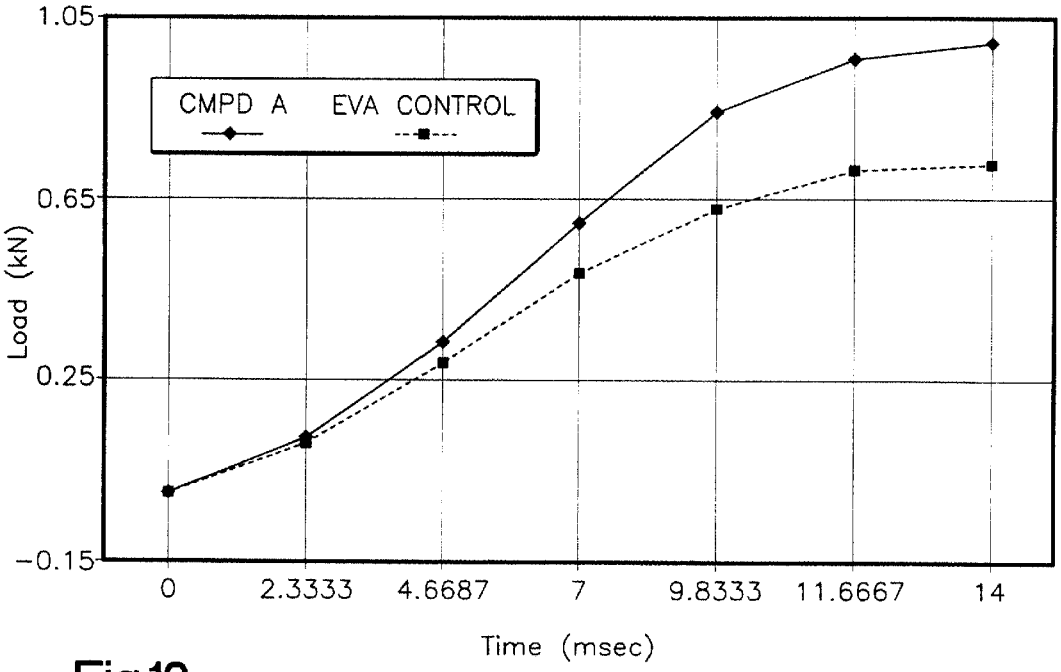
FIG. 13 shows a graph of the load versus time for the thermoplastic material used in the mouthguard of the present invention as compared with conventionally used EVA.

Using ASTM-D3763, Compound B, a 50/50 blend of EVA/TPU, was evaluated and the impact properties are summarized in Table 3. A total of five specimens were tested and measurements were taken and then averaged for impact energy (joules), impact velocity (m/sec), energy to maximum load (joules), and total impact energy (joules). As seen in Table 3, the average energy to maximum load was determined to be 24.28 joules and the total impact energy was 25.86 joules. As seen in FIG. 10, when Compound B is compared to the EVA control, there is nearly a 21 percent increase in the total energy absorbed during impact. As seen in FIG. 11, when Compound B is compared to the EVA control, there is nearly a 380 percent increase in the energy to maximum impact. Further physical data for the 75/25 EVA/TPU blend is shown in FIG. 13.

TABLE 3

| Compound B | | | | |
|---|---|---|---|---|
| SPECIMEN NUMBER | IMPACT ENERGY (joules) | IMPACT VELOCITY (m/sec) | ENERGY TO MAXIMUM LOAD (joules) | TOTAL ENERGY (Joules) |
| 1 | 116 | 2.24 | 24.9 | 26 |
| 2 | 116 | 2.25 | 24.4 | 25.5 |
| 3 | 117 | 2.25 | 25.11 | 25.9 |
| 4 | 116 | 2.24 | 24.6 | 25.7 |
| 5 | 116 | 2.24 | 22.4 | 26.2 |
| Average | 116.2 | 2.244 | 24.282 | 25.86 |

EXAMPLE 4

Using ASTM-D3763, Compound C, a modified EVA material, was evaluated and the impact properties are summarized in Table 4. A total of five specimens were tested and measurements were taken and then averaged for impact energy (joules), impact velocity (m/sec), energy to maximum load (joules), and total impact energy (joules). As seen in Table 4, the average energy to maximum load was determined to be 7.4 joules and the total impact energy was 17.4 joules. As seen in FIG. 10, when Compound C is compared to the EVA control, there is nearly a 20 percent decrease in the total energy absorbed during impact. As seen in FIG. 11, when Compound A is compared to the EVA control, there is nearly a 40 percent increase in the energy to maximum impact.

TABLE 4

| Compound C | | | | |
|---|---|---|---|---|
| SPECIMEN NUMBER | IMPACT ENERGY (joules) | IMPACT VELOCITY (m/sec) | ENERGY TO MAXIMUM LOAD (joules) | TOTAL ENERGY (Joules) |
| 1 | 116 | 2.23 | 7.4 | 18 |
| 2 | 116 | 2.23 | 8.5 | 18 |
| 3 | 117 | 2.24 | 6.7 | 17 |
| 4 | 116 | 2.24 | 7.1 | 16 |
| 5 | 116 | 2.24 | 7.3 | 18 |
| Average | 116.2 | 2.236 | 7.4 | 17.4 |

EXAMPLE 5

Figure 12:
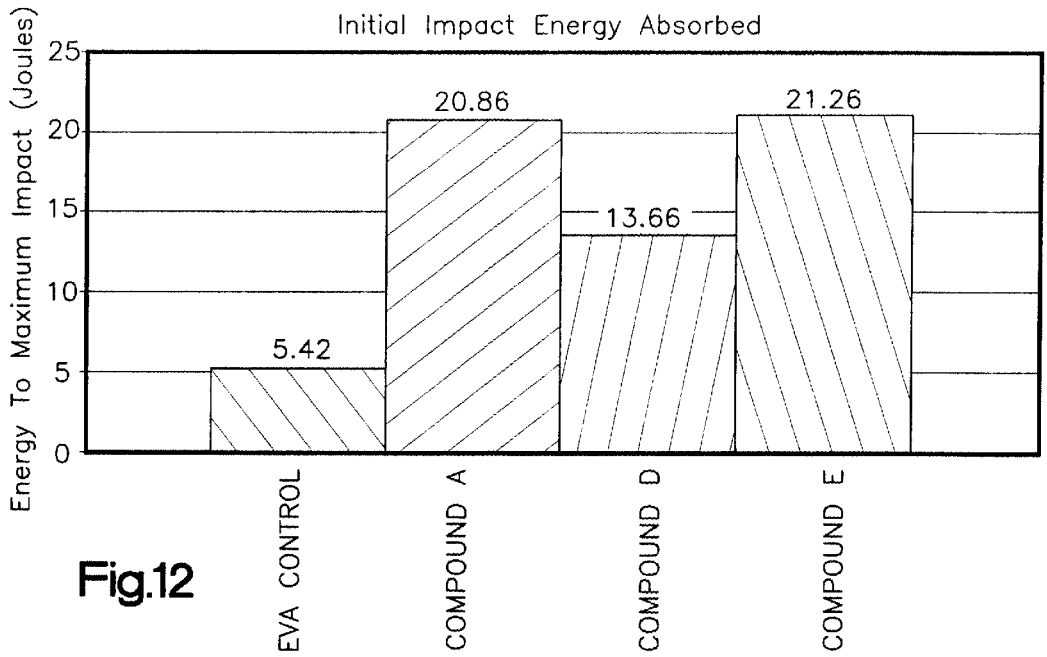
FIG. 12 shows a graph of the energy to maximum impact for the thermoplastic materials used in the mouthguard of the present invention as compared with conventionally used EVA.

Using ASTM-D3763, Compound D, a 75/25 blend of EVA/high flow low durameter TPU material, was evaluated and the impact properties are summarized in Table 5. A total of five specimens were tested and measurements were taken and then averaged for impact energy (joules), impact velocity (m/sec), and energy to maximum load (joules). As seen in Table 5, the average energy to maximum load was determined to be 13.66 joules. As seen in FIG. 12, when Compound D is compared to the EVA control, there is nearly a 150 percent increase in the energy to maximum impact.

TABLE 5

| Compound D | | | |
|---|---|---|---|
| SPECIMEN NUMBER | IMPACT ENERGY (joules) | IMPACT VELOCITY (m/sec) | ENERGY TO MAXIMUM LOAD (joules) |
| 1 | 119 | 2.26 | 16.6 |
| 2 | 119 | 2.26 | 13.4 |

TABLE 5-continued

| Compound D | | | |
|---|---|---|---|
| SPECIMEN NUMBER | IMPACT ENERGY (joules) | IMPACT VELOCITY (m/sec) | ENERGY TO MAXIMUM LOAD (joules) |
| 3 | 119 | 2.26 | 13.0 |
| 4 | 119 | 2.26 | 13.0 |
| 5 | 119 | 2.26 | 12.3 |
| Average | 119 | 2.26 | 13.66 |

EXAMPLE 6

Using ASTM-D3763, Compound E, a 45/45/10 blend of KRATON/TPU/EVA material, was evaluated and the impact properties are summarized in Table 6. A total of five specimens were tested and measurements were taken and then averaged for impact energy (joules), impact velocity (m/sec), and energy to maximum load (joules). As seen in Table 6, the average energy to maximum load was determined to be 21.26 joules. As seen in FIG. 12, when Compound F is compared to the EVA control, there is nearly a 300 percent increase in the energy to maximum impact.

TABLE 6

| Compound E | | | |
|---|---|---|---|
| SPECIMEN NUMBER | IMPACT ENERGY (joules) | IMPACT VELOCITY (m/sec) | ENERGY TO MAXIMUM LOAD (joules) |
| 1 | 117 | 2.24 | 21.2 |
| 2 | 116 | 2.24 | 21.3 |
| 3 | 116 | 2.23 | 21.0 |
| 4 | 116 | 2.24 | 21.0 |
| 5 | 116 | 2.23 | 21.8 |
| Average | 116.2 | 2.236 | 21.26 |

It is to be understood that the embodiments of the invention described above is intended to be illustrative and not restrictive. The novel EVA/TPU blends described herein may have application in sporting equipment, and specifically protective sporting gear. Those skilled in the art will realize other embodiments upon reading and understanding the specification. Therefore, the scope of the invention will include these realized embodiments and the scope of the appended claims or the equivalents thereof.

What is claimed is:

1. A mouthguard, fitted to the molar and incisor teeth and gums of a human user, comprising:

a blend comprising ethylene vinyl acetate (EVA) and thermoplastic urethane (TPU).

2. The mouthguard of claim 1, wherein the EVA is present in the range of about 5 to about 95% by weight.

3. The mouthguard of claim 1, wherein the mouthguard is fitted at a temperature in excess of 100° C. with reference to a model of the human user's teeth.

4. The mouthguard of claim 1, wherein the mouthguard is fitted at a temperature of less than 100° C. with direct reference to the human user's teeth.

5. The mouthguard of claim 4, wherein:

the mouthguard comprises a generally U-shaped body with an upper surface and a lower surface, the upper surface having a channel fitted to the upper molar and incisor teeth and gums of the user;

a first arm portion of the body corresponding to the right upper molars and gums of the user;

a second arm portion of the body corresponding to the left upper molars and gums of the user; and a base portion joining the first and second arm portions, the base portion corresponding to the incisors and gums of the user.

6. The mouthguard of claim 5, further comprising:

a first cushion pad in the first arm portion and a second cushion pad in the second arm portion.

7. The mouthguard of claim 6, wherein the first and second cushion pads are elastomerically resilient at the fitting temperature.

8. The mouthguard of claim 7, wherein the first and second cushion pads comprise a blend of EVA and TPU;

wherein the EVA is present in the range of about 50 to about 75% by weight and the balance is TPU.

9. The mouthguard of claim 6, further comprising:

a maxillary shield pad in the base portion.

10. The mouthguard of claim 5, further comprising:

a maxillary shield pad in the base portion.

11. The mouthguard of claim 8 wherein the first and second cushion pads and the maxillary shield pad are formed as a unitary framework.

12. The mouthguard of claim 1 1, wherein the framework is embedded in the U-shaped body.

13. The mouthguard of claim 9 wherein the framework further comprises:

a tether portion extending outwardly from the base portion of the U-shaped body.

14. The mouthguard of claim 3, wherein the mouthguard is elastomerically resilient at a temperature of less than 100° C.

15. The mouthguard of claim 2, wherein the blend further comprises a thermoplastic rubber.

16. The mouthguard of claim 15, wherein the thermoplastic rubber is present in the range of about 5 to about 45% by weight.

* * * * *